US009119496B2

(12) United States Patent
Chang

(10) Patent No.: US 9,119,496 B2
(45) Date of Patent: Sep. 1, 2015

(54) WINDOW BLIND

(71) Applicant: NIEN MADE ENTERPRISE CO., LTD., Taichung (TW)

(72) Inventor: Chih-Yao Chang, Taichung (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 12 days.

(21) Appl. No.: 13/927,546

(22) Filed: Jun. 26, 2013

(65) Prior Publication Data

US 2015/0000847 A1 Jan. 1, 2015

(51) Int. Cl.
*A47H 3/04* (2006.01)
*A47H 23/00* (2006.01)

(52) U.S. Cl.
CPC . *A47H 3/04* (2013.01); *A47H 23/00* (2013.01)

(58) Field of Classification Search
CPC ..... E05B 9/30; A47H 3/04; A47H 5/00
USPC ..... 160/168.1 R, 173 R, 178.1 R
See application file for complete search history.

(56) References Cited

U.S. PATENT DOCUMENTS

| | | | | | |
|---|---|---|---|---|---|
| 2,091,579 | A * | 8/1937 | Balthasar | ..... | 160/173 R |
| 2,367,095 | A * | 1/1945 | Byer | ..... | 160/173 R |
| 2,401,283 | A * | 5/1946 | Williams | ..... | 160/173 R |
| 2,513,895 | A * | 7/1950 | Seagaard | ..... | 160/173 R |
| 2,523,038 | A * | 9/1950 | Mayer | ..... | 160/173 R |
| 7,150,130 | B2 * | 12/2006 | Kobayashi et al. | ..... | 52/210 |
| 2003/0201071 | A1 * | 10/2003 | Kobayashi et al. | ..... | 160/10 |

* cited by examiner

*Primary Examiner* — Blair M Johnson
(74) *Attorney, Agent, or Firm* — Ming Chow Sinorica, LLC

(57) ABSTRACT

A window blind includes a headrail, a bottom rail, a plurality of slats, and a cord. The slats are arranged between the headrail and the bottom rail, and each slat has two bores and one or plural of locking slots. Each locking slot has an open end and a closed end, and the opening end of the locking slot is connected to the bore. The cord passes through the headrail and the bores of the slats, and being fastened to the bottom rail. A diameter of the cord is greater than or equal to a width of the locking slot. As a result, the cord goes into the locking slot quickly and can be clamped by edges of the locking slot while a kid is trying to pull the cord out of the slats.

7 Claims, 9 Drawing Sheets

WINDOW BLIND

BACKGROUND OF THE INVENTION

1. Technical Field

The present invention relates to a covering of an opening of a building, and more particularly to a window blind with safety slats.

2. Description of Related Art

FIG. 1 shows a conventional window blind 1, including a headrail 10, a bottom rail 12, a plurality of slats 14, and a transmission unit 16. The slats 14 are parallel, and are arranged between the headrail 10 and the bottom rail 12. Each slat 14 has two elongated bores 142. Each bore 142 has curved opposite ends. The transmission unit 16 has two lifting control devices 18 and two cords 20. The lifting control devices 18 are received in the headrail 10. Each cord 20 has a control section 202 and a lift section 204. The control section 202 connects to the lift section 204. The lift sections 204 run over the lifting control devices 18, then pass through the bores 142 of the slats 14 in sequence, and finally are fastened to the bottom rail 12. The control sections 202 extend out of the headrail 10 to be operated by user. Pulling or releasing the control sections 202 may lift or lower the bottom rail 12 to retract or extend the slats 14.

When the bottom rail 12 is lowered to the lowest position, it has a risk to let a kid be strangled in case he/she pulls the lift sections 204 between the slats 14 out, and get the lift sections 204 around his/her neck (seeing FIG. 2). It is because that the lift sections 204 are free to move in the bores 142, so that the kid may pull them out easily and cause a tragedy.

BRIEF SUMMARY OF THE INVENTION

In view of the above, the primary objective of the present invention is to provide a window blind, which makes the kids difficult to pull the lift section out of the slats.

In order to achieve the objective of the present invention, a window blind includes a headrail, a bottom rail, a plurality of slats, and at least a cord is invented. The slats are arranged between the headrail and the bottom rail, and each slat has at least a bore and at least a locking slot. The locking slot has an open end and a closed end, and the open end of the locking slot is connected to the bore. The cord passes through the headrail and the bores of the slats, and is fastened to the bottom rail. A diameter of the cord is preferred to be greater than or equal to a width of the locking slot.

Therefore, the cord goes into the locking slot quickly and is clamped by edges of the locking slot while a kid is trying to pull the cord out of the slats. As a result, the cord is unable to be pulled out of the slats to prevent accidents.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
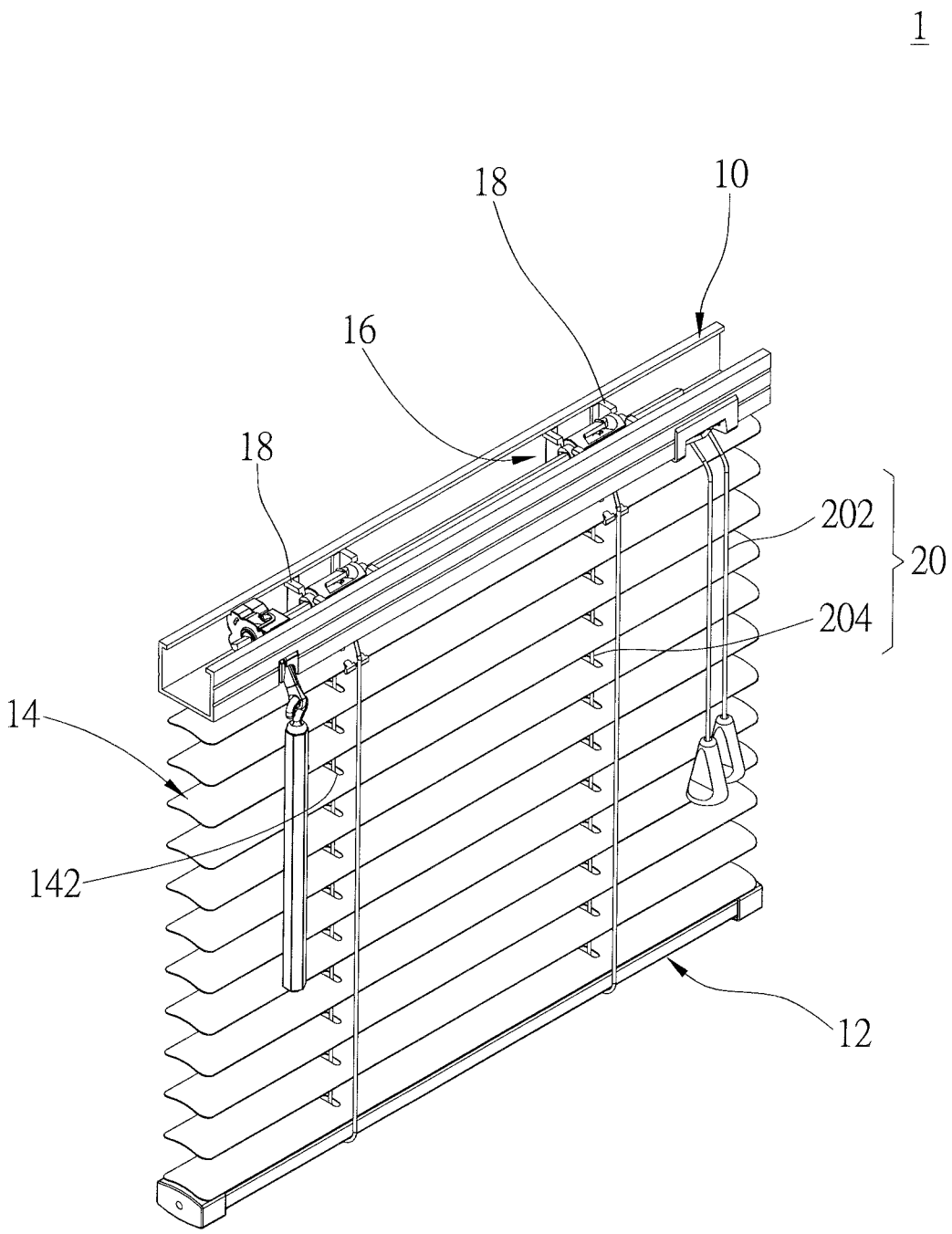
FIG. 1 (PRIOR ART)
FIG. 1 is a perspective view of the conventional window blind.
Figure 2:
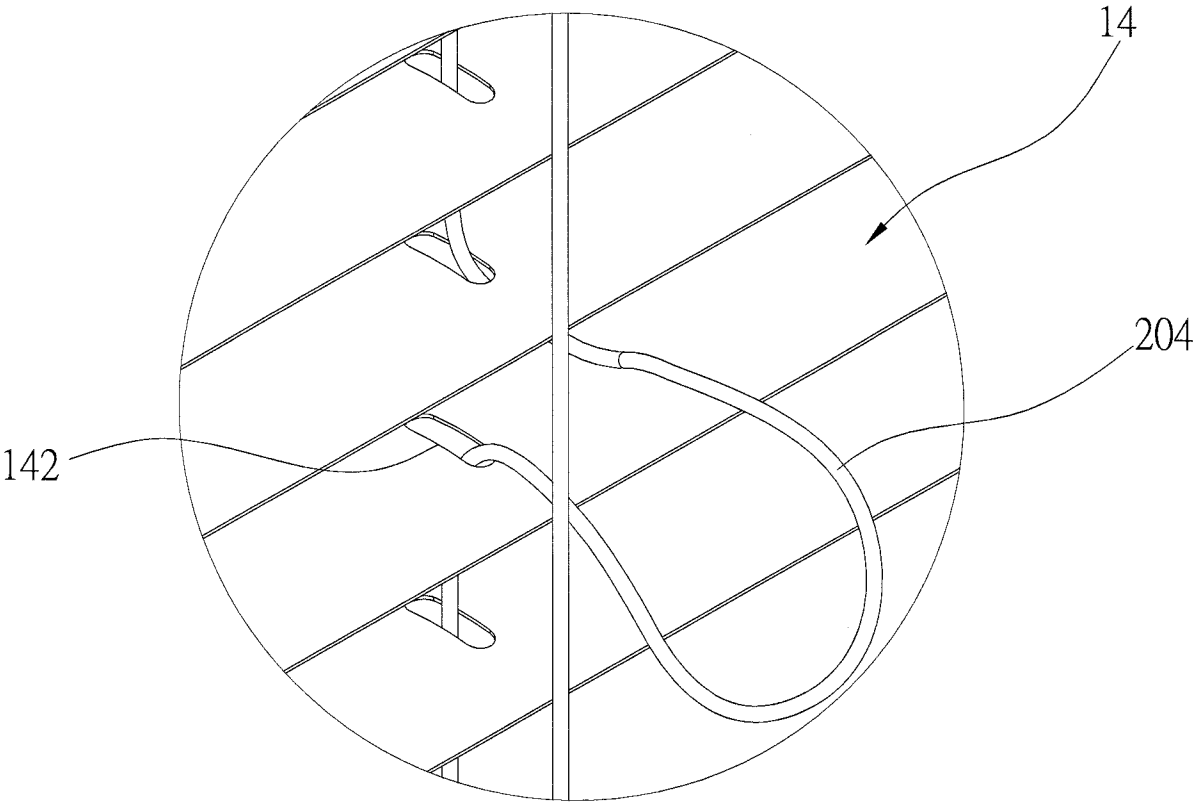
FIG. 2 (PRIOR ART)
FIG. 2 is a perspective view of the conventional window blind, showing the lift section being pulled out of the slats.
Figure 3:
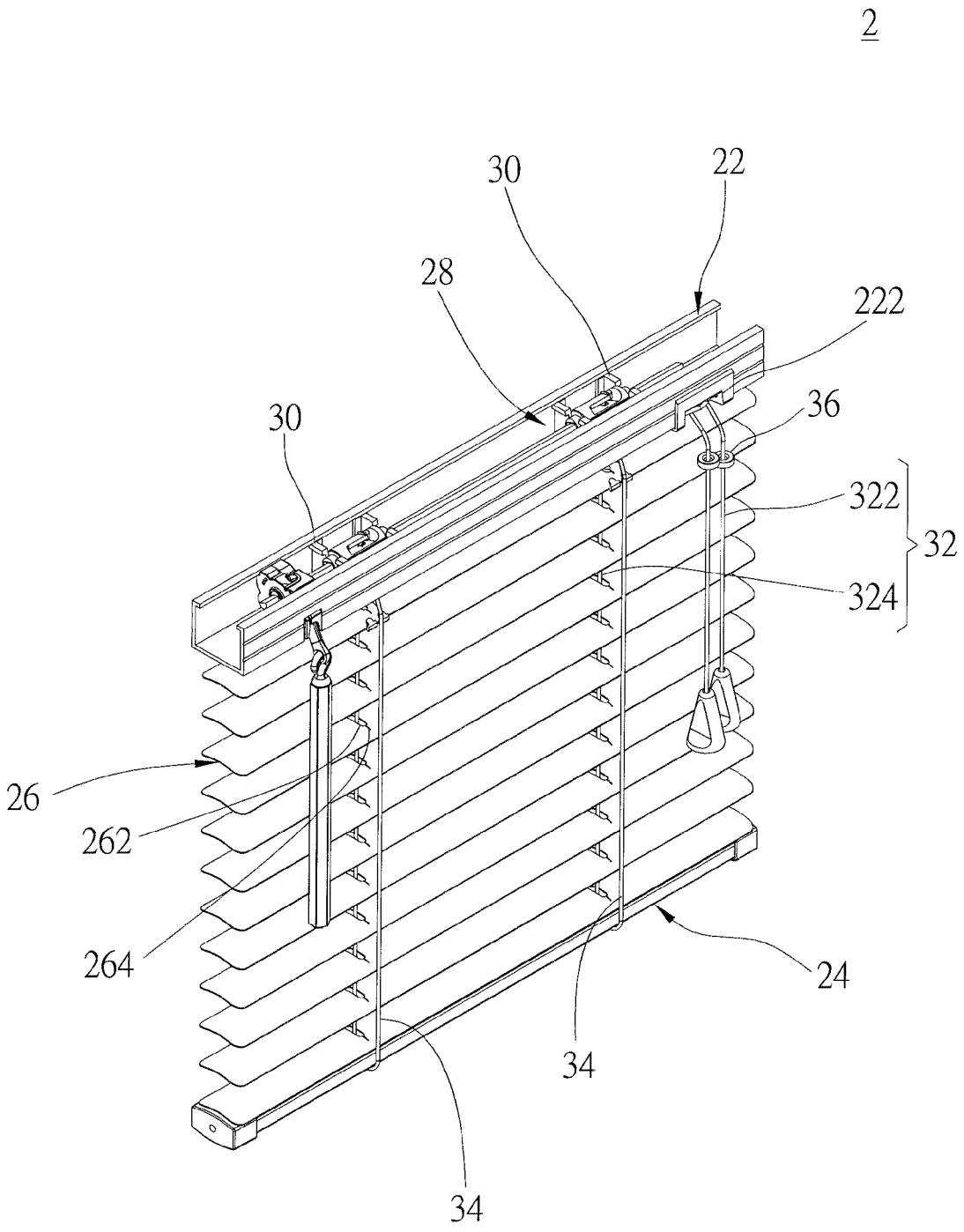
FIG. 3 is a perspective view of a first preferred embodiment of the present invention.
Figure 4:
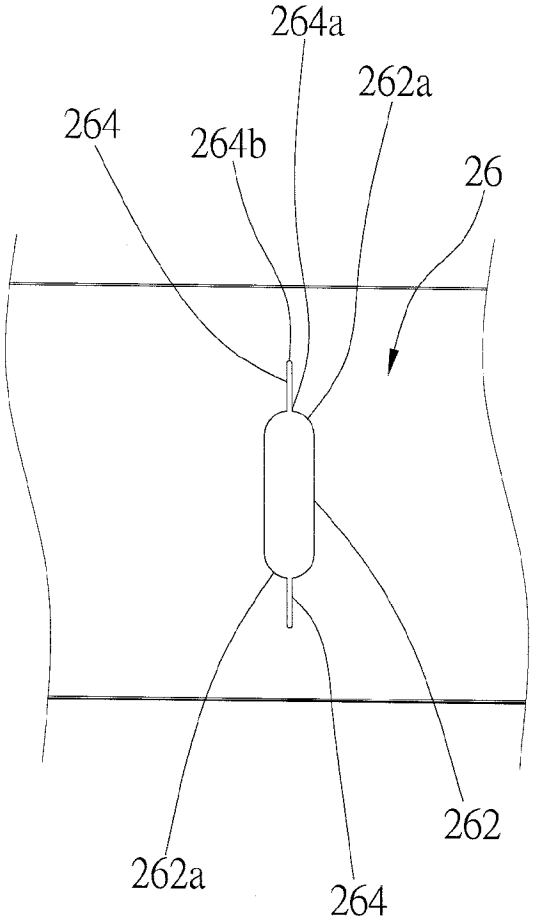
FIG. 4 is a top view of the slat of the first preferred embodiment of the present invention, showing the bore and the locking slots of the slat.

As shown in FIG. 3 and FIG. 4, a window blind of the first preferred embodiment of the present invention includes a headrail 22, a bottom rail 24, a plurality of slats 26, and a transmission unit 28.

The headrail 22 is fixed on a wall. The slats 26 are parallel, and are arranged between the headrail 22 and the bottom rail 24. Two ladders 34 connect the slats 26 to the headrail 22 and the bottom rail 24. Each slat 26 is provided with two elongated bores 262, each of which has a long axis and a short axis. The bore 262 has two concave edges in the long axis to form collecting portions 262*a*. The width of the collecting portion 262*a* is gradually narrowed to guide the cord to the opposite ends of the bore 262. The long axes of the bores 262 are perpendicular to a long axis of the slat 26.

The slat 26 further is provided with two locking slots 264 at the opposite ends of each bore 264. The locking slots 264 are parallel to the long axis of the bore 262. Each locking slot 264 has an open end 264*a* connected to the collecting portion 262*a* of the bore 262 and a closed end 264*b* distal to the collecting portion 262*a*. Precisely, the open end 264*a* of the locking slot 264 is connected to a narrowest portion of the collecting portion 262*a*. The locking slot 264 has a constant width.

The transmission unit 28 has two lifting control devices 30 and two cords 32. The lifting control devices 30 are received in the headrail 22. Each cord 32 has a control section 322 and a lift section 324. The control sections 322 are left out of the headrail 22 via an opening 222 to be operated by a user. The lift sections 324 run over the lifting control devices 30, then pass through the bores 262 of the slats 26 in sequence, and finally are fastened to the bottom rail 24. A diameter of the lift section 324 is greater than or equal to the width of the locking slot 264 to achieve the best result. The bottom rail 24 is lifted and lowered by pulling or releasing the control sections 322. The lifting control devices 30 are the same as the conventional devices, so we do not describe the detail here.

Figure 5:
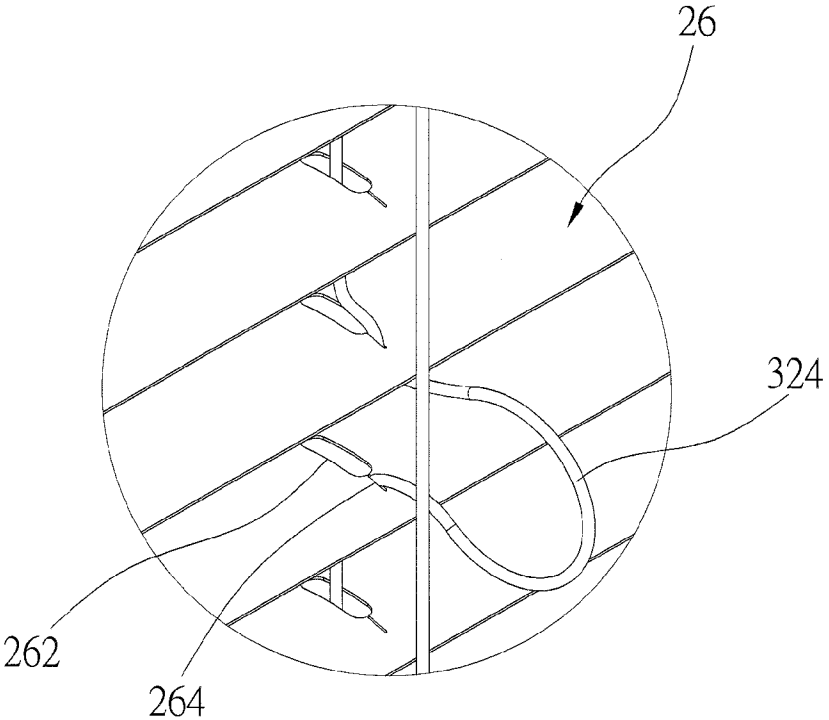
FIG. 5 is a perspective view of the first preferred embodiment of the present invention, showing the lift section in the locking slots.

As shown in FIG. 5, when a kid pulls the lifting section 324 out of the slats 26, the lifting section 324 will go into the locking slot 264 quickly because of the collecting portion 262*a*. Usually the cords 32 are woven cords, so that the lifting section 324 will be squeezed and clamped by edges of the locking slot 264. There will be only a short lifting section 324 being pulled out before the lifting section 324 is clamped by the locking slot 264. However, the length of the pull-out lifting section 324 is insufficient to run over the kid's neck to create a safety hazard.

Figure 6:
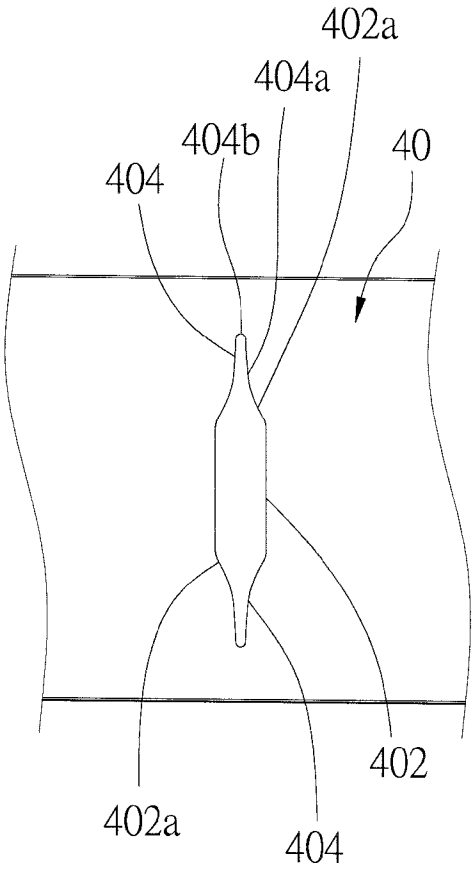
FIG. 6 is a top view of the slat of a second preferred embodiment of the present invention.

FIG. 6 shows a slat 40 of the second preferred embodiment of the present invention, on which two elongated bores 402 are provided (only one bore is shown in figures). The bore 402 has two collecting portions 402*a* at opposite ends in the long axis, and each collecting portion 402*a* is connected with a locking slot 404. The locking slot 404 has an open end 404*a* and a closed end 404*b*, and the open end 404*a* is connected to the narrowest portion of the collecting portion 402*a*. A width of the locking slot 404 is gradually narrowed from the open end 404*a* to the closed end 404*b*. In this embodiment, the locking slot 404 has two convex edges, and it may have two straight and inclined edges in other embodiments.

The control sections are provided with stop members 36. The stop members 36 are bigger than the opening 222 of the headrail 22. While the lifting section 324 between the slats 26 is pulled, it will move the control sections 322 and the stop members 36 upwards, and the lifting section 324 can't be pulled anymore when the stop members 36 are against the headrail 22. It is another safety feature.

Figure 7:
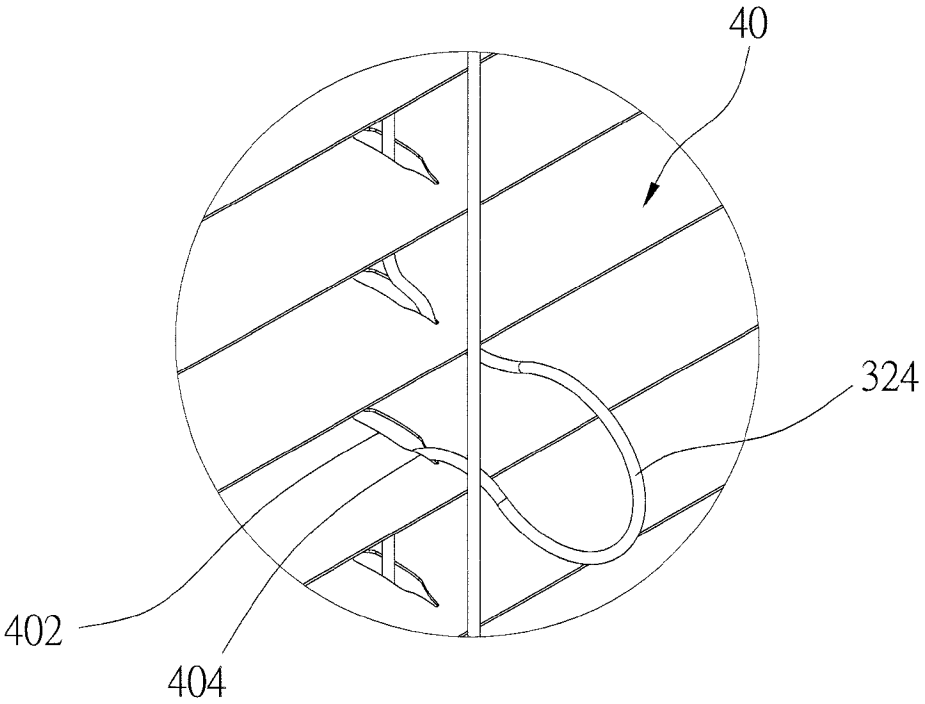
FIG. 7 is a perspective view of the second preferred embodiment of the present invention, showing the lift section in the locking slots.

As shown in FIG. 7, when the lifting section 324 is pulled, it will enter the locking slot 404 quickly and be clamped. As the lifting section 324 is pulled harder, the locking slot 404 will come closer to the closed end 404*b*, and the clamping strength of the locking slot 404 will increase. It makes kids unable to pull the lifting section 324 further out no matter how hard he/she exerts.

Figure 8:
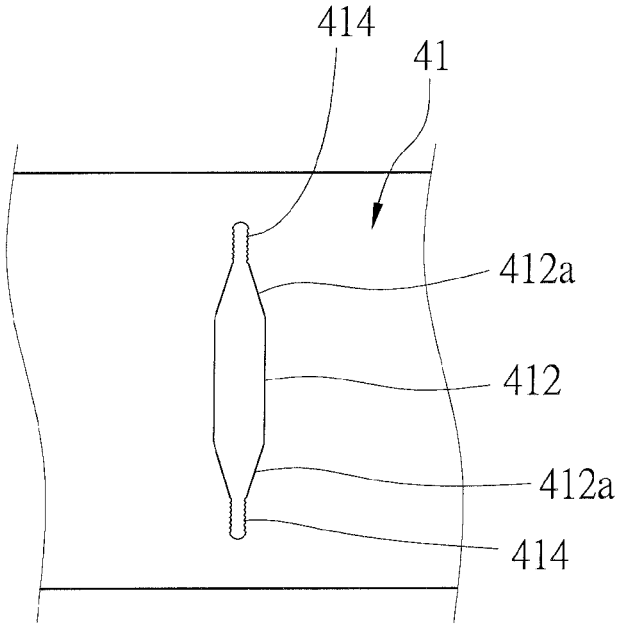
FIG. 8 is a top view of the slat of a third preferred embodiment of the present invention.

FIG. 8 shows a slat 41 of the third preferred embodiment of the present invention, on which two elongated bores 412 are provided (only one bore is shown in figures). The bore 412 has two collecting portions 412*a* at opposite ends in the long axis, and each collecting portion 412*a* is connected with a locking slot 414. The locking slot 414 has two toothed edges, which may enlarge the clamping power of the locking slot 414. The toothed edges may have regular or in regular saw-like or wave-like teeth.

Figure 9:
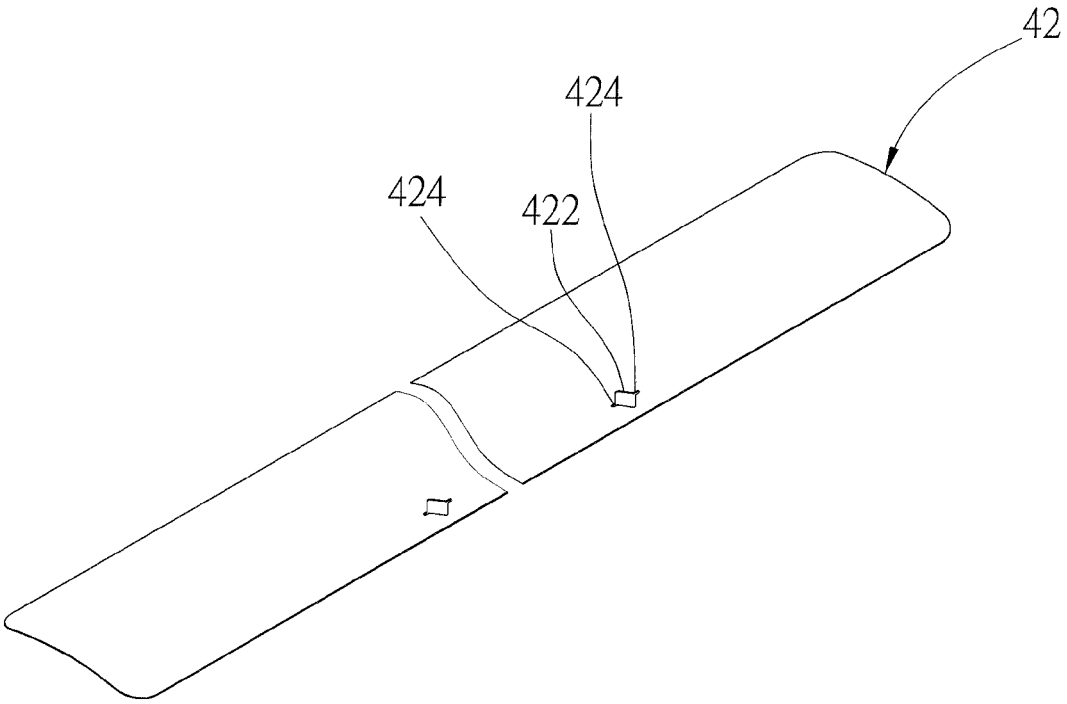
FIG. 9 is a perspective view of the slat of a fourth preferred embodiment of the present invention.
Figure 10:
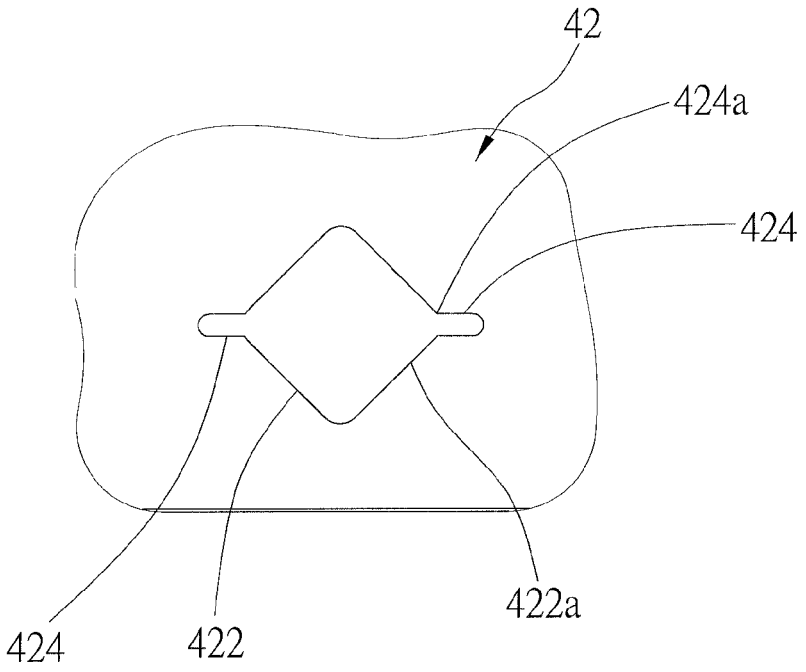
FIG. 10 is a top view of the slat of the fourth preferred embodiment of the present invention.

FIG. 9 and FIG. 10 show a slat 42 of the fourth preferred embodiment of the present invention, on which two diamond bores 422 are provided. Two locking slots 424 are connected to opposite corners of each bore 422 in a long axis of the slat 42. The sides of diamond bore 422 form a collecting portion 422*a* at each corner. The fourth preferred embodiment has the same function as above. An alternate design of the diamond bores 422 is that the locking slots 424 are connected to opposite corners of the bore 422 in a short axis of the slat 42 (not shown).

Figure 11:
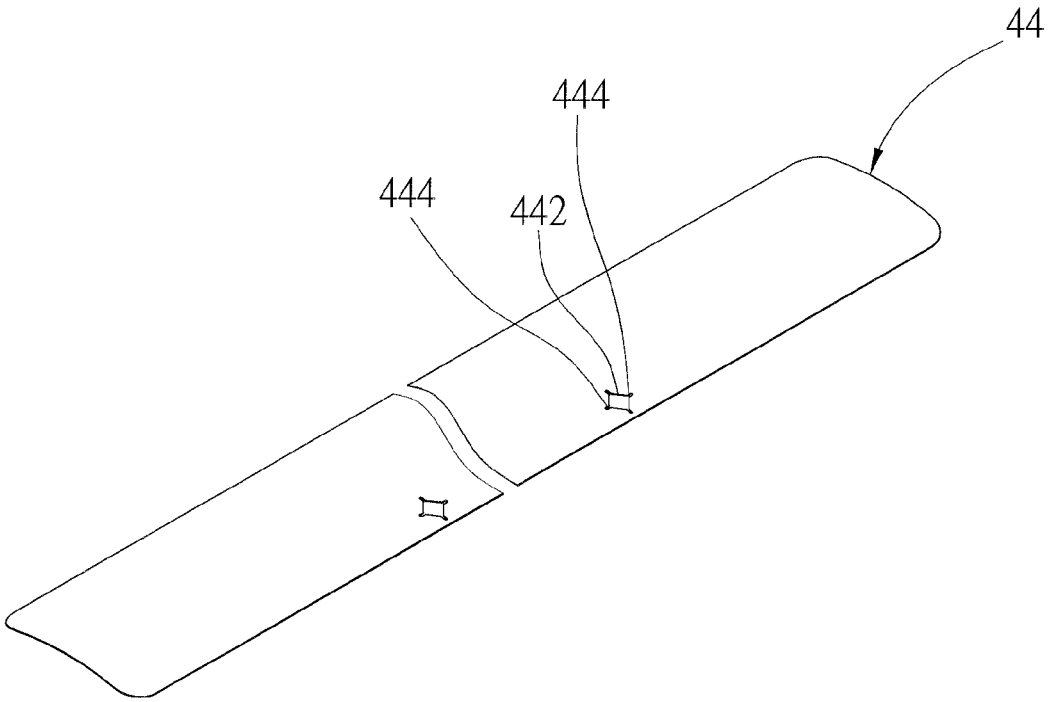
FIG. 11 is a perspective view of the slat of a fifth preferred embodiment of the present invention.
Figure 12:
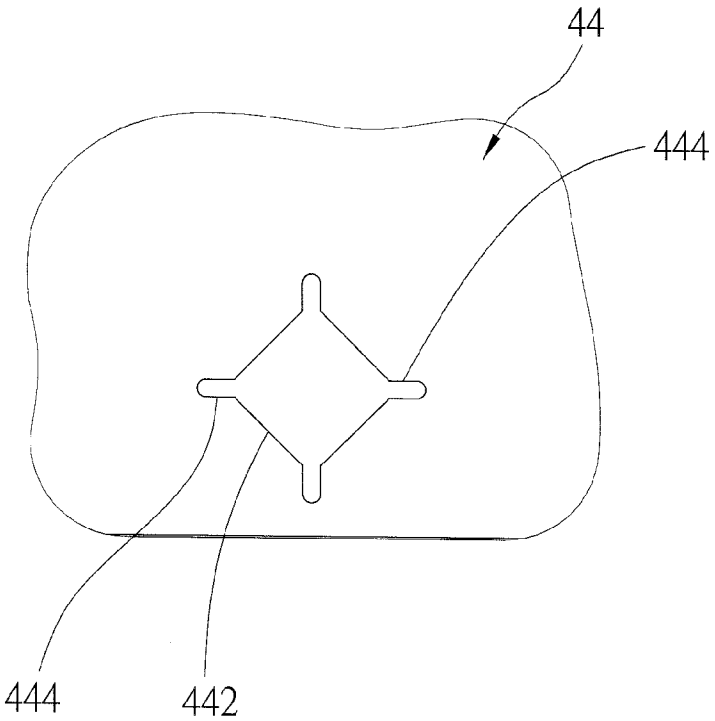
FIG. 12 is a top view of the slat of the fifth preferred embodiment of the present invention.

FIG. 11 and FIG. 12 show a slat 44 of the fifth preferred embodiment of the present invention, on which two diamond bores 442 are provided. Four locking slots 444 are connected to corners of the bore 442 respectively. The lift section will enter any one of the locking slots 444 no matter what direction the kid pulls the cord.

Figure 13:
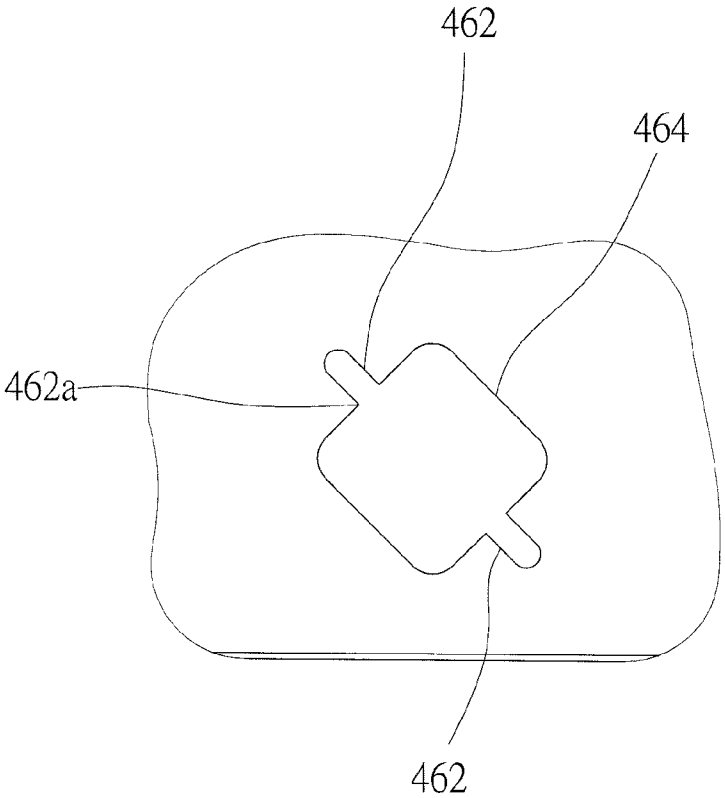
FIG. 13 is a top view of the slat of a sixth preferred embodiment of the present invention.
Figure 14:
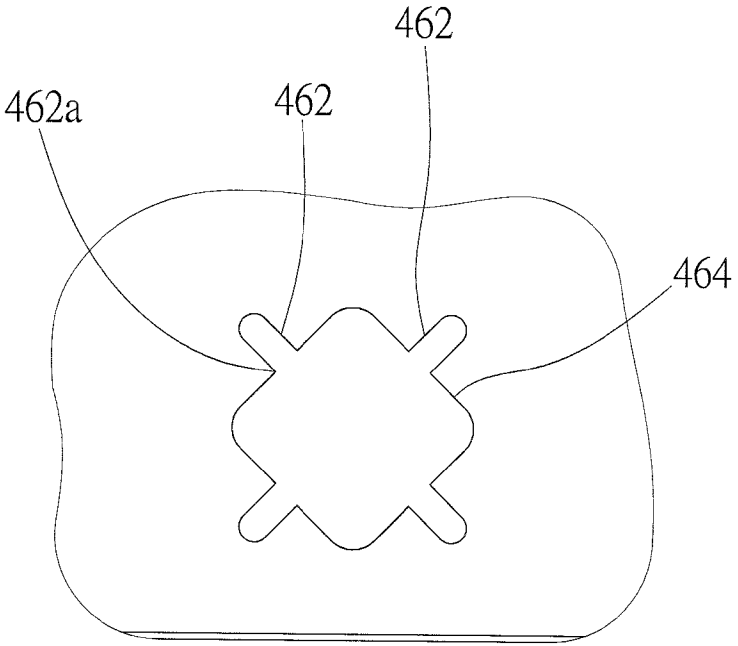
FIG. 14 is a top view of the slat of a seventh preferred embodiment of the present invention.

It is easy to understand that the bores on the slats may be in any shape or any polygon, such as pentagon, hexagon, or heptagon, and the locking slots are connected to the corners thereof. FIG. 13 and FIG. 14 show the sixth and the seventh embodiments of the present invention, which are the alternate designs of the fourth and the fifth embodiments. The diamond bore 422 and 442 are connected with two or four locking slots 424, 444 at opposite sides or all sides of the bore 422 and 442. They have the same function as above.

Figure 15:
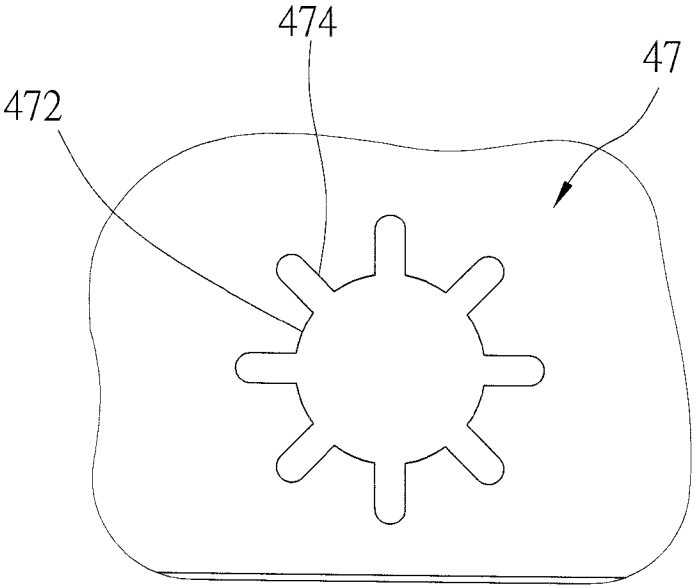
FIG. 15 is a top view of the slat of an eighth preferred embodiment of the present invention.

FIG. 15 shows a slat 47 of the eighth preferred embodiment of the present invention, on which two bores 472 and sixteen locking slots 474 are provided (only one bores 472 and eight locking slots 474 are shown in the figure). In the eighth preferred embodiment, the bore 472 is round, and the locking slots 474 are distributed equally around the bore 472. It will be understood that less locking slots (e.g. two locking slots) can always be used in each bore to achieve the similar clamping result.

It is noted that the shapes of the locking slot shown in FIG. 4 (straight edges), FIG. 6 (curved edges), and FIG. 8 (toothed edges) may be applied in all the embodiments of the present invention.

In conclusion, the bores and the locking slots on the slat may provide a safe operation. While a kid pulls the cord out of the slats, the cord will go into the locking slot quickly, and the kid is unable to pull the cord out anymore. Therefore, the cord, which has been pulled out by the kid, is too short to run over the kid's neck to create a safety hazard. In practice, there might be three or more bores on a slat, and each bore might have one or plural of locking slots. The design of the present invention may be applied in the cordless window blind as well.

It must be pointed out that the embodiments described above are only some preferred embodiments of the present invention. All equivalent structures which employ the concepts disclosed in this specification and the appended claims should fall within the scope of the present invention.

What is claimed is:

1. A window blind, comprising:

a headrail and a bottom rail;

a plurality of unitary slats arranged between the headrail and the bottom rail, each of which has at least a bore and at least a locking slot, wherein the locking slot has an open end and a closed end, the closed end is defined by a surface of the unitary slat, and the open end of the locking slot is connected to the bore;

at least a cord passing through the headrail and the bores of the slats, and being fastened to the bottom rail;

the diameter of the cord is greater than the width of the locking slot; and the cord stays in the bore, and when the cord is pulled, the cord goes into the locking slot and is held therein, and a movement of the cord through the unitary slat is clamped, wherein the bore is an elongated bore having a long axis and a short axis, and the locking slot is in the long axis.

2. The window blind of claim 1, wherein the bore has a collecting portion, which has a gradually narrowed width, and the locking slot is connected to a narrowest portion of the collecting portion.

3. The window blind of claim 1, wherein the width of the locking slot is constant.

4. The window blind of claim 1, wherein the width of the locking slot is gradually reduced from the open end to the closed end.

5. The window blind of claim 1, wherein the locking slot has two convex edges.

6. The window blind of claim 1, wherein the locking slot has two straight edges.

7. The window blind of claim 1, wherein the locking slot has two toothed edges.

* * * * *